US006843382B2

(12) United States Patent
Kanouchi et al.

(10) Patent No.: US 6,843,382 B2
(45) Date of Patent: Jan. 18, 2005

(54) SHELF APPARATUS FOR SHOWCASE

(75) Inventors: Akifumi Kanouchi, Isesaki (JP); Nobuo Kanbayashi, Kodama-gun (JP); Shoichi Yamazaki, Maebashi (JP)

(73) Assignee: Sanden Corp., Gunma (JP)

( * ) Notice: Subject to any disclaimer, the term of this patent is extended or adjusted under 35 U.S.C. 154(b) by 0 days.

(21) Appl. No.: 10/375,258

(22) Filed: Feb. 28, 2003

(65) Prior Publication Data

US 2003/0160012 A1 Aug. 28, 2003

(30) Foreign Application Priority Data

Feb. 28, 2002 (JP) ..... 2002-054219

(51) Int. Cl.[7] ..... A47F 5/00

(52) U.S. Cl. ..... 211/90.02; 211/59.2; 211/126.15; 108/102

(58) Field of Search ..... 211/90.02, 59.2, 211/175, 126.15, 119.003; 108/102, 143

(56) References Cited

U.S. PATENT DOCUMENTS 2,357,668 A * 9/1944 Laham ..... 108/45
4,705,175 A * 11/1987 Howard et al. ..... 211/59.2
4,923,070 A * 5/1990 Jackle et al. ..... 211/59.2
5,531,159 A * 7/1996 Stubblefield ..... 108/102
5,673,801 A * 10/1997 Markson ..... 211/59.3
5,735,589 A * 4/1998 Herrmann et al. ..... 312/408
5,749,478 A * 5/1998 Ellis ..... 211/59.2
6,164,462 A * 12/2000 Mumford ..... 211/59.2
6,497,185 B1 * 12/2002 Barrett et al. ..... 108/108
6,659,293 B1 * 12/2003 Smith ..... 211/59.2
2003/0136750 A1 * 7/2003 Fuji et al. ..... 211/90.02

FOREIGN PATENT DOCUMENTS

JP 2529051 Y 12/1996

* cited by examiner

*Primary Examiner*—Robert W. Gibson, Jr.
(74) *Attorney, Agent, or Firm*—Banner & Witcoff, Ltd.

(57) ABSTRACT

In a shelf apparatus for a showcase, which is provided with a shelf support for supporting a shelf plate on which commodities are placed so as to be slidable in a depth direction, the shelf apparatus is constructed so that the shelf support is provided with a locking plate extending in a width direction of the shelf plate, and the shelf plate is provided with a hooking member which is formed with a steel rod member which extends in the depth direction and whose rear portion further extends along the locking plate on a back surface side of the shelf plate, and also which enables the rear portion to be locked to and unlocked from the locking plate by being swayed vertically. When the shelf plate is held on the shelf supports, the rear portion of the hooking member is locked to the locking plate. By doing this, the shelf plate does not slide forward. When the shelf plate is pulled out forward, the hooking member is unlocked from the locking plate by being swayed vertically. By doing this, the shelf plate can be pulled out forward.

10 Claims, 4 Drawing Sheets

SHELF APPARATUS FOR SHOWCASE

BACKGROUND OF THE INVENTION

1. Field of the Invention

The present invention relates to a shelf apparatus provided in tiers in a showcase and, more particularly, to a shelf apparatus in which a shelf plate can be stored on shelf supports and the shelf plate can be pulled out forward.

2. Description of the Related Art

Conventionally, as a shelf apparatus for an open showcase, a shelf apparatus described in Japanese Utility Model Gazette No. 2529051 is publicly known.

This shelf apparatus has a shelf plate on which commodities are placed. Also, the shelf apparatus has shelf supports which support the shelf plate so that the shelf plate is inclined in such a manner that the front end of shelf plate lowers. Further, the shelf apparatus has a connecting member for connecting the shelf plate to the shelf support. This connecting member connects the shelf plate to the shelf support so that the shelf plate can slide in the depth direction with respect to the shelf support.

When commodities are resupplied onto the shelf plate stored on the shelf supports, the work is performed by the procedure described below. First, the front end of shelf plate is grasped by hands and is pulled out forward. Then, commodities to be resupplied are placed on the shelf plate. Subsequently, the front end of the shelf plate onto which commodities have been resupplied is grasped by hands and is pushed back. Thereby, the shelf plate onto which commodities have been resupplied is fixed on the shelf supports again, thereby completing the resupply work.

A showcase of a type such that the shelf plate is supported horizontally, not to mention a showcase of a type such that the shelf plate is supported so as to be inclined slantwise forward, must has such a construction that the shelf plate is not pulled out forward inadvertently. Therefore, the showcases of these types are provided with a regulating member for regulating a movement of the shelf plate, for example, a plate spring member provided on the shelf support.

Specifically, when the shelf plate is supported on the shelf supports, a tip end of the plate spring member is hooked to a front end of the shelf plate to regulate a forward movement of shelf plate. When the shelf plate is pulled out forward, the plate spring member is pushed to be opened so that the plate spring member is detached from the front end of the shelf plate and a regulation of a shelf plate movement is released. By this operation of the plate spring member, the shelf plate is held on the shelf supports, or the shelf plate is pulled out forward.

However, an elastic force of the plate spring member thereof may be gradually weakened by a continuous use, and finally the plate spring member may lose its shelf plate holding function. Therefore, the plate spring member may be unsuitable for stable use for a long period of time.

SUMMARY OF THE INVENTION

The present invention has been achieved to solve the above problem, and accordingly an object thereof is to provide a shelf apparatus for a showcase, which can be used stably in a continuous manner as a regulating member for regulating a movement of a shelf plate.

The invention of a first aspect provides a shelf apparatus for a showcase, which is provided with a shelf support for supporting a shelf plate on which commodities are placed so as to be slidable in a depth direction, in which the shelf support is provided with a locking plate extending in a width direction of the shelf plate, and the shelf plate is provided with a hooking member which is formed with a steel rod member which extends in the depth direction and whose rear portion further extends along the locking plate on a back surface side of the shelf plate, and also which enables the rear portion to be locked to and unlocked from the locking plate by being swayed vertically.

According to the invention of the first aspect, when the shelf plate is held on the shelf supports (when the shelf plate is in a stored state), the rear portion of the hooking member is locked to the locking plate. By doing this, the shelf plate does not slide forward. On the other hand, when the shelf plate is pulled out forward, the hooking member is unlocked from the locking plate by being swayed vertically. By doing this, the shelf plate can be pulled out forward.

The above and other objects, features, and advantages of the present invention will be apparent from the ensuing description and accompanying drawings.

DESCRIPTION OF THE PREFERRED EMBODIMENTS

FIGS. 1 to 4A, 4B and 4C show one embodiment of a shelf apparatus for a showcase in accordance with the present invention.

Figure 1:
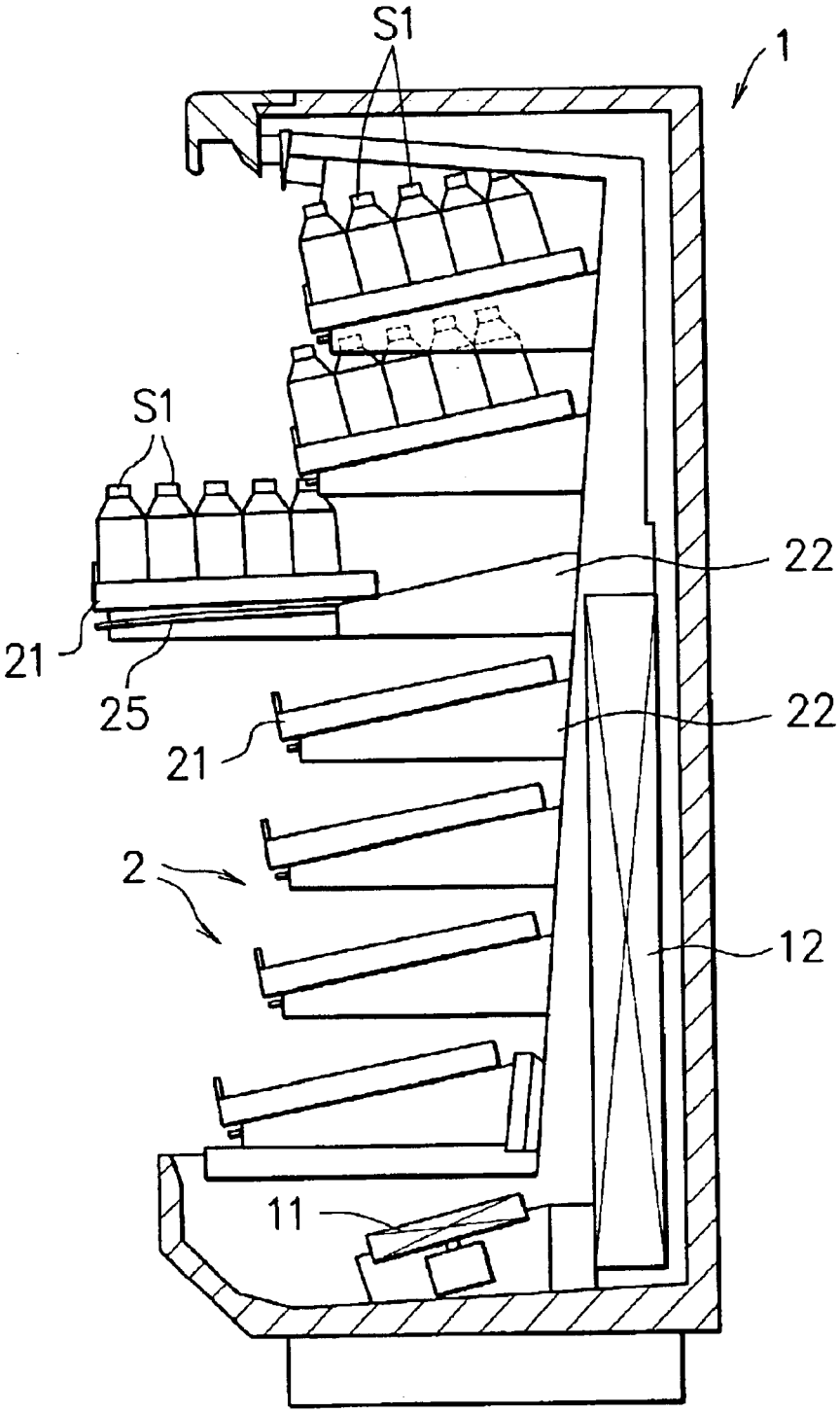
FIG. 1 is a side sectional view of an open showcase.

First, a construction of the showcase will be explained briefly with reference to FIG. 1. The showcase shown in the drawing is a multi-tier open showcase 1 (hereinafter referred to as a showcase 1), in which seven shelf apparatuses 2 are arranged therein. Also, bottled commodities S1 are placed on the shelf apparatus 2. When the commodities S1 are ones requiring refrigeration, the interior of the showcase 1 is cooled by cooling equipment (an in-case circulation fan 11, a cooler 12).

Figure 2:
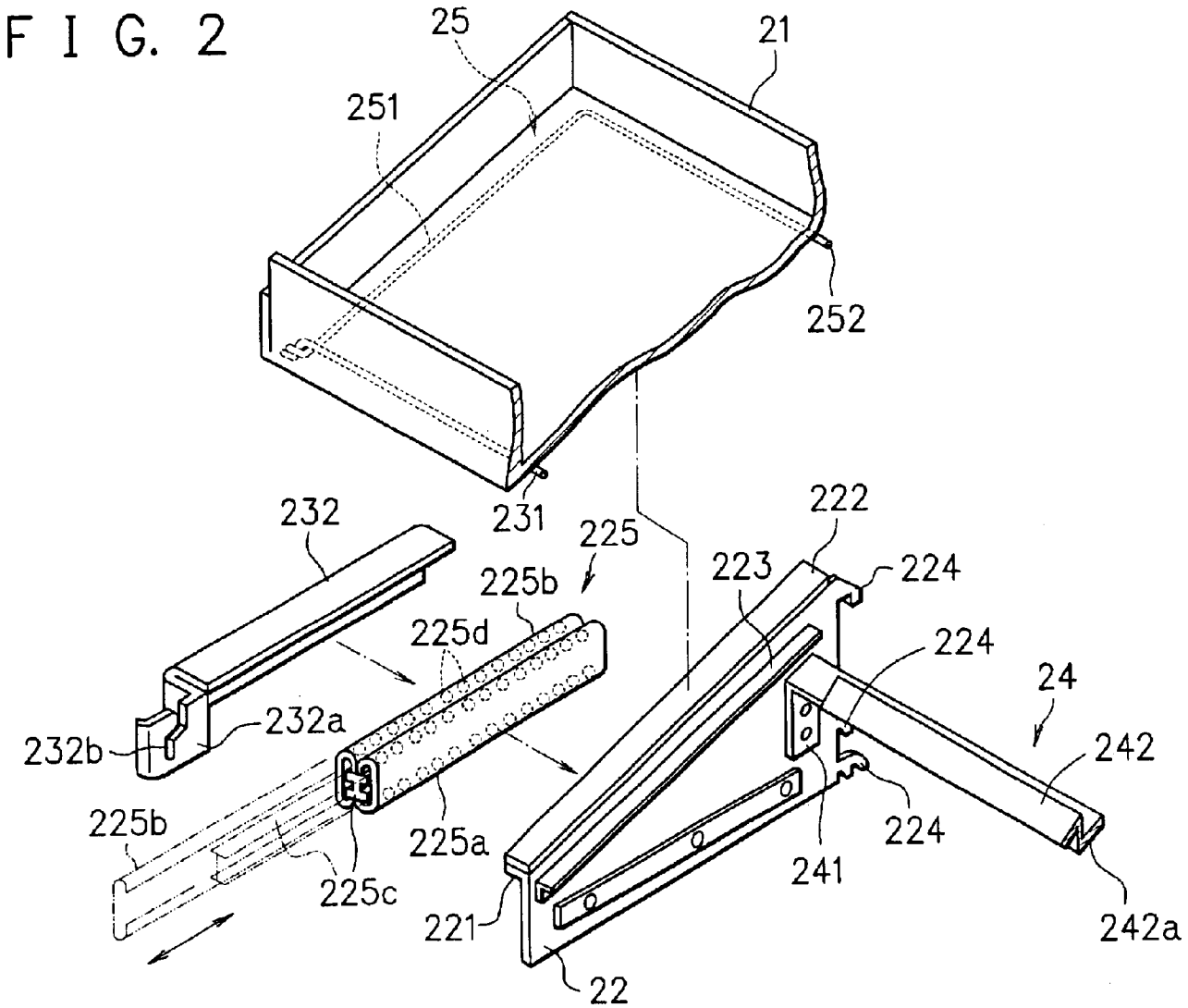
FIG. 2 is an exploded perspective view of a shelf apparatus.

Next, a construction of the shelf apparatus 2 provided in seven tiers in the showcase 1 will be explained with reference to FIGS. 2 to 4. The shelf apparatus 2 has a shelf plate 21 on which the commodities S1 are placed and plate-like shelf supports 22 for supporting the right and left of a lower surface of the shelf plate 21.

Figure 3:
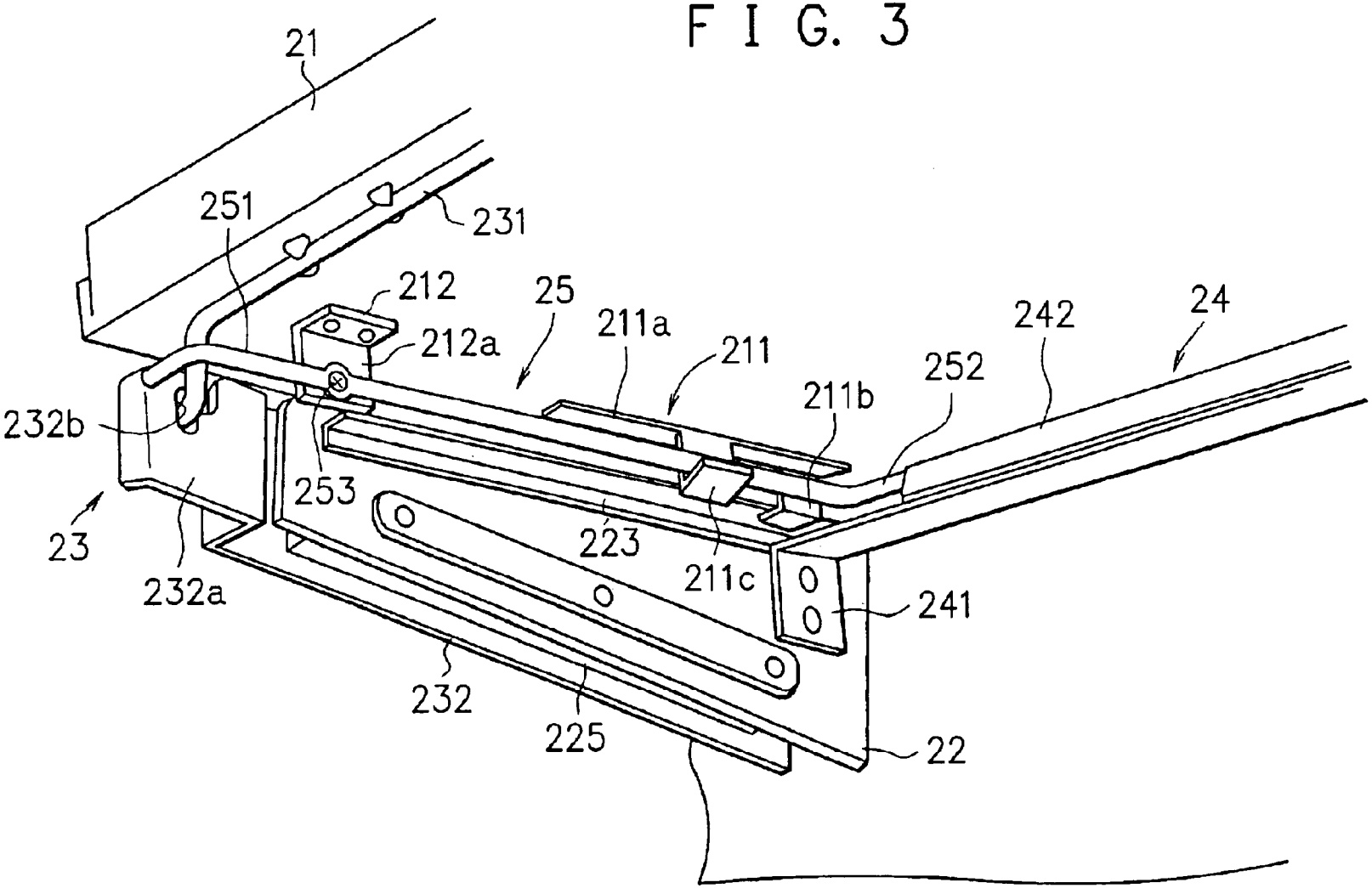
FIG. 3 is a general perspective view of a shelf apparatus.

The shelf plate 21 is of a flat box shape whose upper face is open, and as shown in FIG. 3, a holding member 211 for preventing the shelf plate 21 from coming off is provided at the right and left on the rear side of the lower surface of the shelf plate 21. Although FIG. 3 shows only the holding member 211 on the left side of the shelf plate 21, the holding member 211 is also provided on the right side of the shelf plate 21. The holding member 211 is constructed so that a base plate 211*a* extending in the depth direction is fixed to a back surface of the shelf plate 21. A coming-off preventing plate 211*b* having an L shape in cross section is located at a rear end of the base plate 211*a* and a lower end portion of the coming-off preventing plate 211*b* is bent toward the outside depends from base the plate 211*a*. Also, a supporting plate 211*c* having an L shape in cross section is located substantially at a central position in the depth direction of base plate 211*a* and a lower end portion of supporting plate 211*c* is bent toward the outside depends from base plate 211*a*. The lower plate of the coming-off preventing plate 211*b* is located under an upper plate of a shelf guide plate 223, described later, to prevent a rear portion of the shelf plate 21 from coming off the shelf support 22. A bent portion of the supporting plate 211*c* is located under a longitudinal rod portion 251 of a hooking rod 25, described later, to support the longitudinal rod portion 251. At the right and left on the rear side of the back surface of the shelf plate 21, a rod receiving member 212 is installed as shown in FIG. 3. A depending receiving plate 212*a* of the rod receiving member 212 is pivotally mounted with the hooking rod 25 via a screw shaft 253, described later. Although FIG. 3 shows only the rod receiving member 212 on the left side of the shelf plate 21, the rod receiving member 212 is also provided on the right side of the shelf plate 21.

The shelf support 22 is formed slantwise so that the upper end thereof lowers toward the front end. Although FIGS. 2 to 4 show only the left-hand side shelf support 22, the shelf support 22 is also provided on the right side. As shown in FIG. 2, an upper end portion of the shelf support 22 is bent at right angles toward the outside, and on a bent plate 221 is provided a slide plate 222 so that the shelf plate 21 placed on the slide plates 222 slides smoothly. Also shelf guide plate 223 extending in the depth direction along the upper end of the shelf support 22 is located at an inner surface of the shelf support 211*a*. An upper end portion of the shelf guide plate 223 is bent toward the inside, and the lower plate of the coming-off preventing plate 211*b* is located under the shelf guide plate 223 as described above so that the coming-off preventing plate 211*b* is guided along the shelf guide plate 223. Also, a plurality of hooks 224 are formed so as to be arranged vertically at the rear end of the shelf support 22. These hooks 244 are engaged with predetermined hook holes of many hook holes formed in a shelf pillar, not shown, by which an installation position (height position) of the shelf apparatus 2 is determined. Also, a sliding mechanism 225 extending in the depth direction is fixed on the outer surface of the shelf support 22. This sliding mechanism 225 is a publicly known mechanism, in which an intermediate plate 225*c* is interposed between a fixed plate 225*a* and a movable plate 225*b* as shown in FIG. 2. Bearings 225*d* are interposed between the intermediate plate 225*c* and the fixed plate 225*a* and between the intermediate plate 225*c* and the movable plate 225*b*. Thereby, the movable plate 225*b* can be slid in the depth direction as indicated by a double-headed arrow in FIG. 2.

In the shelf plate 21 and the shelf supports 22 constructed as described above, the shelf plate 21 is attachable to and detachable from the shelf supports 22 via an attaching/detaching member 23. The construction of the attaching/detaching member 23 will be explained with reference to FIGS. 2 and 3.

The attaching/detaching member 23 is composed of a locking rod 231 and a connecting plate 232 which the locking rod 231 is attached to and detached from. The locking rod 231 is provided close to a front end on the back surface of the shelf plate 21, and extends over the entire width in the transverse direction of the shelf plate 21. Both end portions, right and left, of the locking rod 231 are bent downward into an L shape so that the end portion is locked to and unlocked from a locking groove 232*b*, described later.

On the other hand, the connecting plate 232 extends in the depth direction, and is formed so as to cover the whole of the side face and upper face of the sliding mechanism 225. The movable plate 225*b* of the sliding mechanism 225 is fixed on the inner surface of the connecting plate 232. Thereby, the connecting plate 232 is also slid in the depth direction by the sliding motion in the depth direction of the movable plate 225*b* of the sliding mechanism 225. A front portion of the connecting plate 232 is formed with an attachment plate 232*a* bent substantially into an L shape. The attachment plate 232*a* is formed with the locking groove 232*b* extending vertically. The locking groove 232*b* is formed so as to first extend downward from an upper end of the attachment plate 232*a*, further extend slightly in the forward direction from the lower end of the downwardly extending groove, and further extend downward from the front end of the forwardly extending groove. When both ends of the locking rod 231 are locked to the locking grooves 232*b*, the shelf plate 21 is connected to the sliding mechanism 225 via the locking rod 231 and the connecting plate 232, and thereby the shelf plate 21 is made slidable in the depth direction via the sliding mechanism 225.

As described above, the shelf plate 21 is made slidable in the depth direction by the sliding mechanism 225, and also the shelf plate 21 is placed on the shelf supports 22 in a state of being inclined downward toward the front. Therefore, it is necessary to adopt a sliding motion restraining construction for restraining a forward sliding motion of the shelf plate 21.

For the shelf apparatus 2 in accordance with this embodiment, a construction described below is adopted as a sliding motion regulating construction. That is, a locking plate 24 is provided at a position close to the rear end of the shelf supports 22 and arranged at the right and left so as to bridge the shelf supports 22. As shown in FIGS. 2 to 4, the locking plate 24 is composed of attachment base plates 241 fixed to the inner surface of the shelf supports 22 and a locking plate 242 extending in the width direction of the shelf plate 21 from the upper ends of the attachment base plates 241. The locking plate 242 has a locking portion 242*a* whose front side is bent substantially into a Z shape in cross section so that the hooking rod 25 (described later) hooked to the locking portion 242*a* cannot be moved forward. Both ends of the locking plate 24 are connected to rear portions of the right and left shelf supports 22. Thereby, the right and left shelf supports 22 are made integrated, so that each of the shelf supports 22 is set on the right and left shelf pillars at the same time.

Also, the hooking rod 25 is provided as the sliding motion regulating construction. As shown in FIGS. 2 and 3, the hooking rod 25 is composed of a longitudinal rod portion 251 extending from the front side to the rear of the shelf plate 21 and a transverse rod portion 252 extending in the width direction of the shelf plate 21 from the rear end of the longitudinal rod portion 251. The longitudinal rod portion 251 and the transverse rod portion 252 are integrally formed of one steel rod. The transverse rod portion 252 extends so as to correspond to the locking portion 242*a*, and is normally locked to the locking portion 242*a*. The longitudinal rod portion 251 is pivotally mounted to the receiving plate 212*a* with a screw shaft 253 so that when a front end of the longitudinal rod portion 251 is pulled downward as indicated by a two-dot chain line in FIG. 4A, the transverse rod portion 252 turns upward and comes out of the locking portion 242*a*. Thus, by the pulling-up or pulling-down operation of the longitudinal rod portion 251, the transverse rod portion 252 sways vertically, so that the hooking rod 25 is locked to or unlocked from the locking portion 242*a*.

Figure 4A:
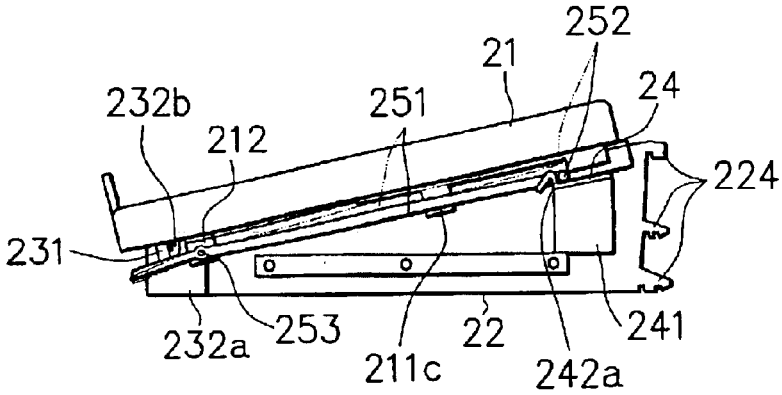
FIGS. 4A, 4B and 4C are side views showing sliding and removing operations of a shelf plate.

Successively, the operation for pulling out the shelf apparatus 2 will be described mainly with reference to FIGS. 4A, 4B and 4C. When the shelf plate 21 is placed on the shelf supports 22, the transverse rod portion 252 of the hooking rod 25 is locked to the locking portion 242*b* of the locking plate 24 as shown in FIG. 4A, and hence the forward movement of the shelf plate 21 is restrained.

On the other hand, when the shelf plate 21 is pulled out forward, first, the front sides of the longitudinal rod portions 251 of the hooking rod 51 are pulled downward. Thereby, as indicated by a two-dot chain line in FIG. 4A, the transverse rod portion 252 is turned upward and is moved to above the locking portion 242*a* of the locking plate 24, so that the transverse rod portion 252 of the hooking rod 25 is unlocked from the locking portion 242*a*.

When the locked state of the hooking rod 25 is released in this manner, the shelf plate 21 is pulled forward. Thereby, as shown in FIG. 4B, the shelf plate 21 is pulled out forward via the sliding mechanisms 225. Thereafter, commodities S1 are resupplied on the shelf plate 21, for example, as in the case of the third shelf apparatus 2 from the top in FIG. 1.

After a work for resupplying commodities S1 has been finished, the shelf plate 21 is pushed toward the rear ends of the shelf supports 22. By doing this, the transverse rod portion 252 of the hooking rod 251 gets over the locking plate 242, and is locked again to the locking portion 242*a* as shown in FIG. 1.

Figure 4B:
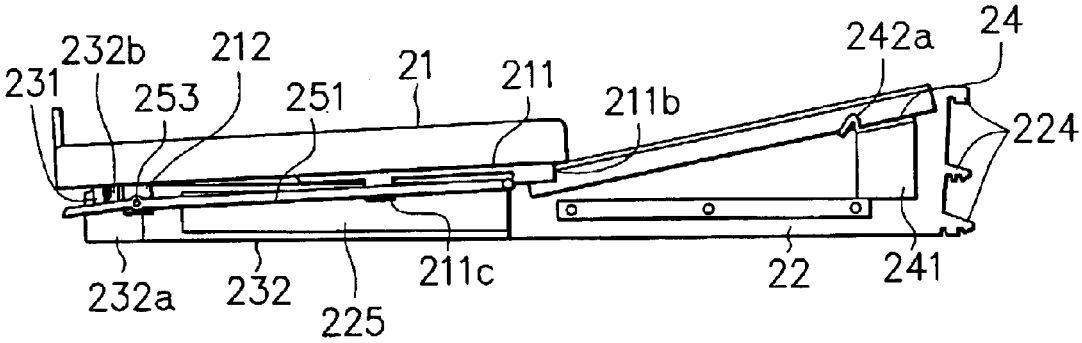
Figure 4C:
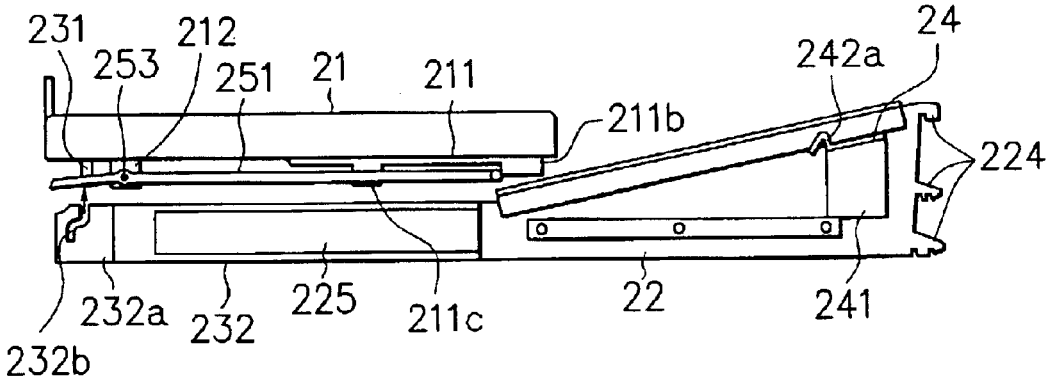

On the other hand, when the arrangement position of the shelf apparatus 2 is changed by changing the space between the shelves or the like, the shelf plate 21 is pulled out forward as shown in FIG. 4B. Subsequently, as shown in FIG. 4C, the locking rod 231 is unlocked from the locking groove 232*b* while the shelf plate 21 is lifted. Thereby, the shelf plate 21 is separated from the shelf supports 22. After this work for separating shelf plate 21 has been finished, the hooks 224 of the shelf support 22 are detached from the shelf pillar, and the shelf support 22 is hooked at a location corresponding to the changed arrangement position. Thereafter, the locking rod 231 of the shelf plate 21 is fitted again into the locking groove 232*b*, and the shelf plate 21 is pushed in and stored on the shelf supports 22.

According to this embodiment, the shelf support 22 is provided with the locking plate 24 extending in the width direction of the shelf plate 21. Also, the shelf plate 21 is provided with the steel hooking rod 25 extending along the locking plate 24 on the back surface side of the shelf plate 21. Since the construction is such that the hooking rod 25 is locked to and unlocked from the locking plate 24 by being swayed vertically, the pulling-out and storing work of the shelf plate 21 may be performed easily.

Also, since the transverse rod portion 252 of the hooking rod 25 is locked to the whole of the locking plate 242 extending in the width direction of the shelf plate 21, a locking strength of the shelf plate 21 is increased, so that the shelf plate 21 may be used stably for a long period of time.

Further, when the arrangement position of the shelf apparatus 2 is changed, the shelf plate 21 can be separated from the shelf supports 22. Therefore, the work for changing the installation position of the shelf support 22 may become easier, and also the positioning of the shelf support 22 can be performed exactly.

In the above-described embodiment, the shelf apparatus in which the shelf plate 21 is stored on the shelf supports 22 in an inclined state has been explained. Needless to say, however, the construction for regulating the sliding motion in accordance with the above-described embodiment can be applied to a shelf apparatus in which the shelf plate 21 is stored in a horizontal state (not shown). Also, although the hooking rod 25 is formed of one rod material ranging from the right and left front ends to the rear of the shelf plate 21, two hooking members (not shown) may be provided separately at the right and left of the shelf plate 21.

What is claimed is:

1. A shelf apparatus for a showcase, the shelf apparatus comprising:

a shelf plate on which commodities may be placed, the shelf plate having a width direction and a depth direction, and the shelf plate including a hooking member; and a shelf support for supporting the shelf plate, the shelf support including a locking plate extending in the width direction, wherein the hooking member is formed from a rod that extends in the depth direction, and a rear portion of the hooking member extends along the locking plate and along a back surface of the shelf plate, and wherein the hooking member may be locked to and unlocked from the locking plate by being swayed vertically, and the shelf plate is slidable in the depth direction when the hooking member is unlocked from the locking plate.

2. The shelf apparatus for a showcase according to claim 1, further comprising an attaching/detaching member that enables the shelf plate to be attached to and detached from the shelf support when the shelf plate is moved in the depth direction relative to the shelf support.

3. The shelf apparatus for a showcase according to claim 1, wherein the hooking member has a longitudinal rod and a transverse rod formed integral with each other, the longitudinal rod extending from a front side to a rear of the shelf plate, and the transverse rod extending from an end of the longitudinal rod and in the width direction.

4. The shelf apparatus for a showcase according to claim 2, wherein the hooking member has a longitudinal rod and a transverse rod formed integral with each other, the longitudinal rod extending from a front side to a rear of the shelf plate, and the transverse rod extending from an end of the longitudinal rod and in the width direction.

5. The shelf apparatus for a showcase according to claim 1, wherein the hooking member is provided in pairs at a right side and a left side of the shelf plate.

6. The shelf apparatus for a showcase according to claim 2, wherein the hooking member is provided in pairs at a right side and a left side of the shelf plate.

7. The shelf apparatus for a showcase according to claim 1, wherein the shelf plate is supported on a pair of the shelf support, and ends of the locking plate are fixed to inside faces of the pair of the shelf support.

8. The shelf apparatus for a showcase according to claim 1, wherein a coming-off preventing plate with an L-shaped cross-section is provided on a lower surface of the shelf plate, and the shelf support is provided with a shelf guide plate for guiding the coming-off preventing plate in the depth direction while holding the coming-off preventing plate.

9. The shelf apparatus for a showcase according to claim 1, wherein the shelf support has a supporting plate for supporting the hooking member from a lower side.

10. The shelf apparatus for a showcase according to claim 1, wherein the hooking member is pivotally-mounted on the shelf plate so as to be capable of being turned vertically.

* * * * *